US006901900B2

(12) United States Patent
Matsubayashi et al.

(10) Patent No.: US 6,901,900 B2
(45) Date of Patent: Jun. 7, 2005

(54) RECOIL STARTER FOR BACKPACK TYPE POWER WORKING MACHINE

(75) Inventors: Tatsuhiko Matsubayashi, Kanagawa (JP); Satoru Kikuchi, Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/353,202

(22) Filed: Jan. 28, 2003

(65) Prior Publication Data

US 2003/0140884 A1 Jul. 31, 2003

(30) Foreign Application Priority Data

Jan. 31, 2002 (JP) ..... 2002-022705

(51) Int. Cl.[7] ..... F02N 3/02
(52) U.S. Cl. ..... 123/185.3
(58) Field of Search ..... 123/185.2, 185.3, 123/185.4

(56) References Cited

U.S. PATENT DOCUMENTS

| | | | | |
|---|---|---|---|---|
| 3,010,443 A | | 11/1961 | Lyvers | 123/179 |
| 3,164,142 A | | 1/1965 | Anderson et al. | 123/179 |
| 3,306,277 A | | 2/1967 | Gudmundsen | 123/185 |
| 3,861,374 A | | 1/1975 | Dooley et al. | 123/179 |
| 4,850,233 A | | 7/1989 | Ishigo | 74/6 |
| 5,287,832 A | | 2/1994 | Uhl | 123/185 |
| 5,537,966 A | | 7/1996 | Ohnishi | 123/185.14 |
| 5,979,015 A | * | 11/1999 | Tamaribuchi | 16/110.1 |
| 6,508,220 B1 | | 1/2003 | Akaike et al. | 123/185.14 |
| 2003/0056746 A1 | * | 3/2003 | Tezuka et al. | 123/185.3 |

FOREIGN PATENT DOCUMENTS

| | | |
|---|---|---|
| JP | 5223025 | 6/1977 |
| JP | 191075 | 6/1989 |
| JP | 213171 | 1/1990 |

OTHER PUBLICATIONS

Japanese Utility Model Publication H2–48695 (1990) with the English translation abstract thereof.
Japanese Utility Model Unexamined Publication (Kokai) No. S59–19975 for "An Engine Starter for a Pruning Machine" with English translation of claim, Feb. 1984.
Japanese Utility Model Publication H6–3188 for "A Starter for Internal Combustion Engine" with English translation of Claim 1, Jan. 1994.

(Continued)

*Primary Examiner*—Andrew M. Dolinar
(74) *Attorney, Agent, or Firm*—Baker Botts LLP

(57) ABSTRACT

A recoil starter for a backpack type power working machine, which is capable of easily performing the starting operation of an internal combustion engine with the working machine being carried on the operator's back. In this recoil starter, the recoil rope and the recoil handle are disposed so as to be pulled down obliquely forward at an angle of 100° to 150° to the horizontal plane. The recoil handle is formed into a T-shaped configuration in side view, which comprises the grip portion and a laterally extended stopper portion which is formed on a distal end of the grip portion.

2 Claims, 3 Drawing Sheets

OTHER PUBLICATIONS

Japanese Utility Model Publication H7–17810 for "A Power Accumulation Type Starter" with English translation of Claim 1, Apr. 1995.
Japanese Utility Model Publication H7–24614 for "Starter for Internal Combustion Engine" with English translation of Claim 1, Jun. 1995.
Japanese Utility Model Publication H7–24615 for "Starter for Internal Combustion Engine" with English translation of Claim 1, Jun. 1995.
Japanese Application Publication [kokoku] Sho47–50942. Jun. 21, 1977 for "Engine Starting Apparatus" of T. Iura et al..
Japanese Utility Model Application H2–13171 for "Spiral Spring Type Starter for Internal Combustion Engine" with English translation of Claim 1, Jan. 1990.
Japanese Utility Model Application H1–91075 for "Recoil Type Starter" with English translation of Claim 1, Jun. 1989.

* cited by examiner

RECOIL STARTER FOR BACKPACK TYPE POWER WORKING MACHINE

BACKGROUND OF THE INVENTION

1. Field of the Invention

The present invention relates to a recoil starter for an internal combustion engine, and in particular, to a recoil starter to be employed for starting an internal combustion engine which is adapted to be mounted on a backpack type power working machine such as a backpack type power brush cutter, a backpack type power sprayer, etc.

2. Description of the Related Art

The recoil starter to be employed for starting an internal combustion engine such as air-cooled two-stroke gasoline engine which is adapted to be mounted on a backpack type power working machine is generally constructed such that it is provided with a recoil handle (recoil rope) so that the internal combustion engine can be started by pulling the recoil handle against the compression-resisting force of the engine, and that once this recoil handle is released, the recoil rope is automatically wound up to the original state thereof by the effect of recoil-urging means.

When the recoil rope is kept wound up to the original state thereof, i.e. when the engine-starting operation is not performed, the recoil handle is usually kept stayed at the recoil rope outlet port of the main body of the starter. Therefore, it is difficult for the operator to reach the recoil handle under the condition where the working machine is kept shouldered by the operator's back, i.e. it is difficult for the operator to pull the recoil handle for starting the internal combustion engine under such a condition as mentioned above.

Therefore, if the operator wishes to restart the internal combustion engine after the engine is stopped while carrying the working machine on his back, the working machine is required to be dismounted from his back, causing significant inconvenience to the operator.

Whereas, when a D.C. motor type starter is employed as a starter, the internal combustion engine can be easily started while carrying the working machine on the operator's back. In that case however, the total weight of the working machine would be considerably increased due to the D.C. motor and the battery to be used as a power source for the D.C. motor, and the structure of the starter would become complicated, thus increasing the manufacturing cost thereof.

Under the circumstances, there has been proposed a recoil starter which enables an operator to perform the starting operation of the internal combustion engine under the condition where the backpack type power working machine is kept shouldered by the operator's back as disclosed in Japanese Utility Model Unexamined Publication (Kokai) S59-19975 wherein the recoil rope is designed to be guided by a flexible guide pipe up to the operator's shoulder portion. Since this recoil starter is constructed such that the recoil handle thereof (recoil rope and one end of the guide pipe) is not supported at all, it is difficult to smoothly perform the rope-pulling operation. Moreover, since the recoil rope and the guide pipe end are allowed to hang around during the working operation, they may disturb the working operation, thus raising a problem.

On the other hand, Japanese Utility Model Publication H2-48695 discloses a recoil starter wherein a proximal end portion of the guide pipe for guiding the recoil rope is supported by the main body of starter, and a distal end portion of the guide pipe is secured to the shoulder contact portion of the shouldering band. According to this recoil starter, since the recoil handle (grip) is supported at the vicinity of a front portion of the shoulder (or a distal end portion of the guide pipe), the recoil handle can be prevented from being hung up. However, there are problems that the face of the operator may be impinged against the recoil handle, thus hindering the movement of the operator, and that the recoil rope-pulling operation may become difficult.

Additionally, in the case of the conventional recoil starter according to the prior art, since the recoil handle is formed into such a configuration as to enable the recoil handle to be entirely grasped by fingers (i.e. clutch type configuration) in view of the attaching position and the pull-out direction of the recoil handle, it is unavoidable to cause a large magnitude of load to be imposed on the fingers on the occasion of pulling the recoil handle, and moreover, such a configuration is not necessarily convenient to grasp.

BRIEF SUMMARY OF THE INVENTION

The present invention has been made in view of overcoming the aforementioned problems accompanied with the conventional recoil starters, and therefore, it is an object of the present invention to provide a recoil starter for a backpack type power working machine, which is capable of easily performing the starting operation of an internal combustion engine under the condition where the working machine is kept shouldered by the operator's back, which can be manufactured lighter in weight and lower in manufacturing cost as compared with a D.C. motor type recoil starter, and the recoil handle of which is substantially free from hindering the movement of the operator and can be easily grasped by fingers, thereby enabling the recoil handle to be easily pulled out.

With a view to attaining the aforementioned object, there is provided, in accordance with the present invention, a recoil starter for starting an internal combustion engine to be mounted on a backpack type power working machine; which is characterized in that a recoil rope and a recoil handle attached to one end portion of the recoil rope are adapted to be pulled downward from a main body of the recoil starter; and that the recoil handle is provided with a lengthy grip portion whose length is larger than the width of the palm of the operator's hand.

In a preferable embodiment, both of the recoil rope and the recoil handle are disposed so as to be pulled down obliquely forward at an angle of 100° to 150° to the horizontal plane.

The recoil handle is preferably formed into a T-shaped configuration in side view, which comprises the aforementioned grip portion and a laterally extended stopper portion which is formed on a distal end, in the pull-out direction, of the grip portion.

In a preferable embodiment of the backpack type power working machine, the driving power source portion including an inner combustion engine is rotatably supported on a backpack frame so as to enable the driving power source portion to rotate about the vertical line; the main body of the starter is disposed on the right or left side of the driving power source portion; and a working means such as a driving shaft or a manipulating shaft which is provided at a distal end thereof with a cutting blade (in the case of a brush cutter), a spray tube (in the case of a power sprayer), etc. is disposed on the other side of the driving power source portion.

Further, the recoil starter is secured adjustably in position to the driving power source portion.

In a preferable embodiment of the recoil starter of the backpack type power working machine according to the present invention which is constructed as described above, since the recoil handle is disposed so as to be pulled down obliquely forward at an angle of 100° to 150° to the horizontal plane, the starting operation of the recoil starter can be easily performed with the working machine being kept shouldered by the operator's back. Moreover, according to the present invention, since only the mounting posture of the recoil starter and the recoil handle thereof are required to be modified with the main body of the recoil starter for a backpack type power working machine being permitted to be the same as the conventional recoil starter, it is possible to make the recoil starter lighter in weight and lower in manufacturing cost as compared with the D.C. motor type recoil starter. Further, since the recoil handle is positioned on the back of the operator, it is possible to prevent the recoil handle from hindering the movement of the operator during the operation of the power working machine.

Moreover, since the recoil handle is formed into a T-shaped configuration in side view, which comprises the grip portion having a length larger than the width of the palm of the operator's hand and a laterally extended stopper portion which is formed on a distal end, as viewed in the pullout direction, of the grip portion, it is possible to entirely grasp the recoil handle and to manipulate the recoil handle without imposing so much load on the grasping fingers as compared with the conventional clutch type recoil handle, thereby making it possible to easily perform the pulling operation of the recoil handle.

Further, since the recoil handle is made longer as compared with the conventional recoil handle, it is possible for an operator to easily reach the position of the recoil handle while shouldering the power working machine on his back. Additionally, since a laterally extended stopper portion is formed on the grip portion, it becomes possible to prevent the operator's hand from slipping out of the recoil handle, thereby enabling the pullout operation of the recoil handle (starting manipulation of the engine) and making it possible to minimize the failure of the starting manipulation of the engine.

Since the recoil starter for a backpack type power working machine according to the present invention is enabled to perform the starting operation of the engine with the working machine being kept shouldered by the operator's back, it is more preferable to design the recoil starter in such a manner as to enable the engine to be easily started even if the pulling force of the recoil rope is relatively small as compared with a recoil starter where the rope-pulling operation is performed after dismounting the working machine from the operator's back.

As for the recoil starter which enables the start-up of the engine to be performed with a relatively small magnitude of rope-pulling force, there is known a power-accumulating type recoil starter which has been previously proposed by the inventors. This power-accumulating type recoil starter comprises a driving member which can be rotated by the pulling of the recoil rope, a driven member to which the rotation of the driving member is designed to be transmitted, and a buffering/power-accumulating means which is disposed between the driving member and the driven member, wherein the buffering/power-accumulating means is enabled, during the driving process by the driving member, to accumulate the power supplied through the driving process while alleviating any shock to the driven member, the accumulated power being subsequently employed to drive the driven member (for more details, see Japanese Patent Unexamined Publication (Kokai) 2001-132591, which is incorporated herein by reference).

According to this power-accumulating type recoil starter, since the buffering/power-accumulating means (a spiral spring mechanism) is interposed between the driving member and the driven member, it is possible to derive a buffering effect from the spiral spring mechanism during the first-half driving process (until the piston of the internal combustion engine reaches the top dead center thereof) in the pulling operation of the recoil rope (recoiling operation), to enable the pulling force of the recoil rope to be accumulated in the spiral spring mechanism. During the latter-half driving process, the pulling force thus accumulated in the spiral spring mechanism during the first-half driving process is permitted to be combined with the pulling force to be actually effected in the latter-half pulling operation of the recoil rope to thereby generate a resultant force, which is utilized as a force for starting the internal combustion engine. As a result, it is possible to minimize a fluctuation in pulling force of rope so as to smooth the rope-pulling operation, and also to enable the engine to be easily started without necessitating a large magnitude of pulling force.

DETAILED DESCRIPTION OF THE INVENTION

Next, one embodiment of the recoil starter according to the present invention will be explained with reference to the drawings.

Figure 1:
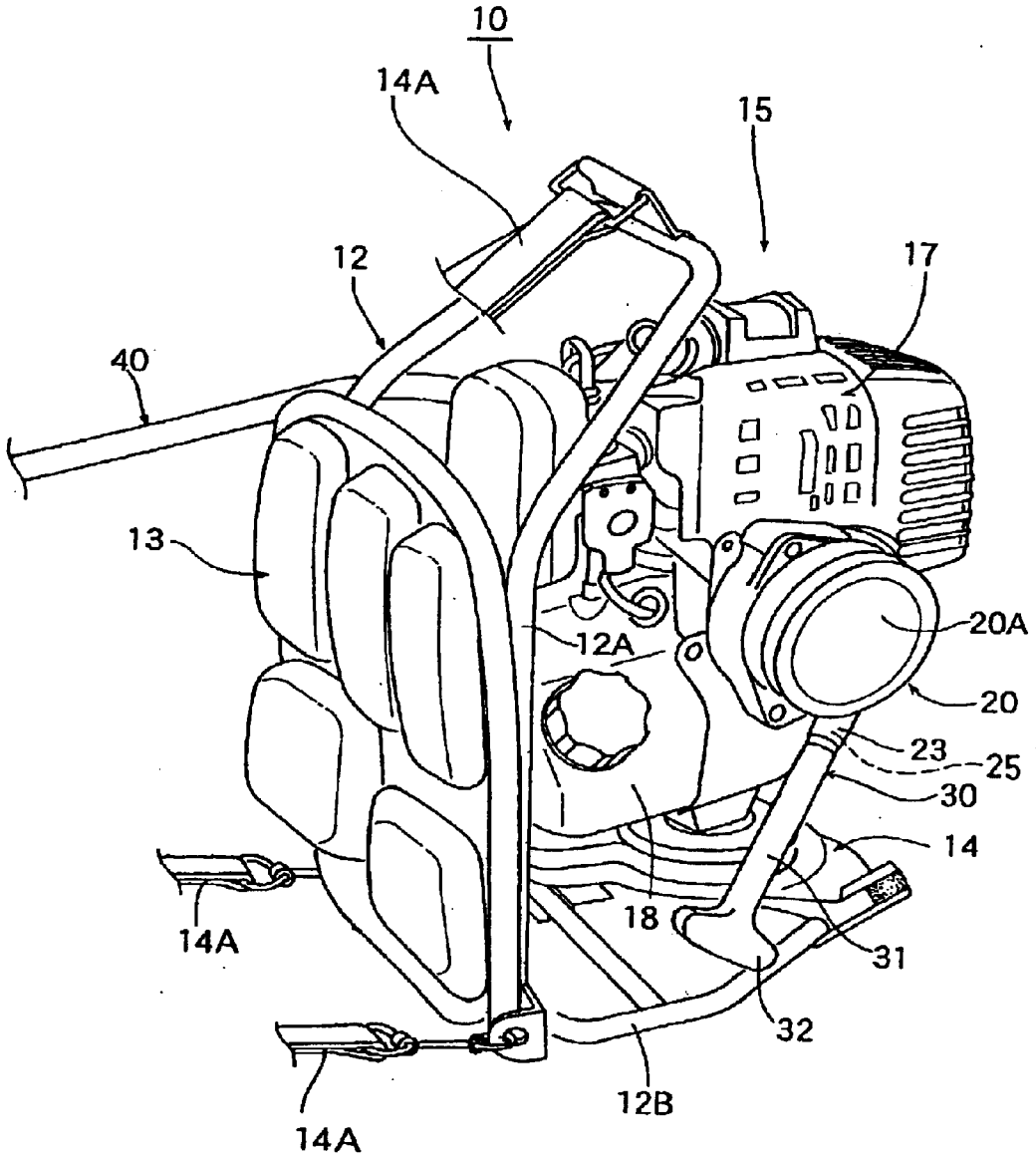
FIG. 1 is a perspective view of a recoil starter representing one embodiment of the present invention, which is shown together with a backpack type power working machine as they are viewed from the left front side thereof.
Figure 2:
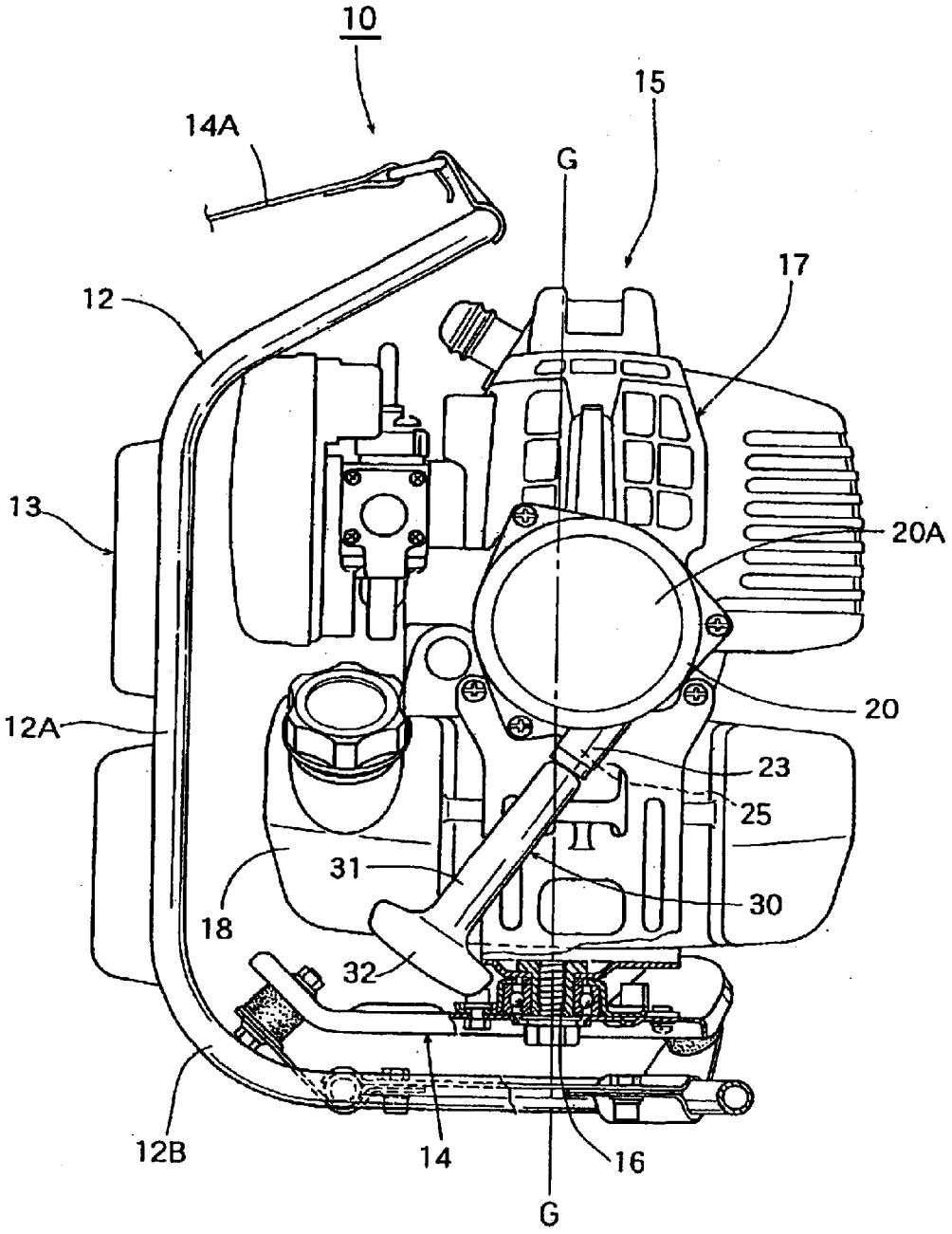
FIG. 2 is a partial sectioned left side view of the backpack type power working machine shown in FIG. 1.

FIG. 1 is a perspective view of a recoil starter representing one embodiment of the present invention, which is shown together with a backpack type power brush cutter as one example of a backpack type power working machine as they are viewed from the left front side thereof, and FIG. 2 is a left side view of the backpack type power brush cutter including the recoil starter both shown in FIG. 1.

Referring to FIGS. 1 and 2, this backpack type power brush cutter 10 comprises an L-shaped (in side view) backpack frame 12 having a pair of shouldering bands 14A, a back-resting pad 13 secured to the vertical frame portions 12A of the shouldering frame 12, and a driving power source portion 15 mounted, through a mounting member 14 acting also as a vibration damping and absorbing member, on the bottom frame portions 12B of the backpack frame 12, this driving power source portion 15 being mainly constituted by an air-cooled two-stroke gasoline engine (internal combustion engine) 17 functioning as the driving power source and by a fuel tank 18.

This driving power source portion 15 is rotatably supported by means of a pivot 16 which is secured to the mounting member 14 so that the driving power source portion 15 is able to rotate about the vertical line G—G in the horizontal plane. A main starter body 20A of the recoil starter 20 according to this embodiment is disposed on the right or left side (in this case, on the left side) of the driving power source portion 15, and a flexible drive shaft built-in tube 40 is disposed as working means on the other side (in this case, on the right side). This flexible drive shaft built-in tube 40 is coupled with a manipulating rod which is provided at a distal end thereof with a working member such as brush cutter (not shown). Therefore, if the driving power source portion 15 is rotated by 180°, the recoil starter 20 can be disposed on the right side of the driving power source portion 15, while the flexible drive shaft built-in tube 40 acting as working means can be disposed on the left side of the driving power source portion 15.

This recoil starter 20 is of a power-accumulating type. It comprises a driving member including a rope reel around which a recoil rope 25 is wound and which is enabled to be rotated as the recoil rope 25 (recoil handle 30) is pulled out, and a spiral spring functioning as recoil-urging means for reversely rotating the rope reel so as to automatically wind up the recoil rope 25. This recoil starter 20 also comprises a driven member to which the rotation of the aforementioned driving member is transmitted, and a spiral spring mechanism functioning as buffering/power-accumulating means, which is disposed between the driving member and the driven member, wherein the buffering/power-accumulating means is enabled, during the driving process by the driving member, to accumulate the power supplied through the driving process by the driving member while alleviating any shock to the driven member, the accumulated power being subsequently utilized to drive the driven member.

The main starter body 20A of the recoil starter 20 is provided with a rope outlet port 23 which is extended obliquely forward from a lower portion the recoil starter 20, thereby directing the rope outlet port 23 toward the operator's back side. As a result, the recoil rope 25 and the recoil handle 30 attached to the distal end of the recoil rope 25 are enabled to be pulled down obliquely toward the operator (see the state of the recoil rope 25 shown in FIG. 3).

Figure 3:
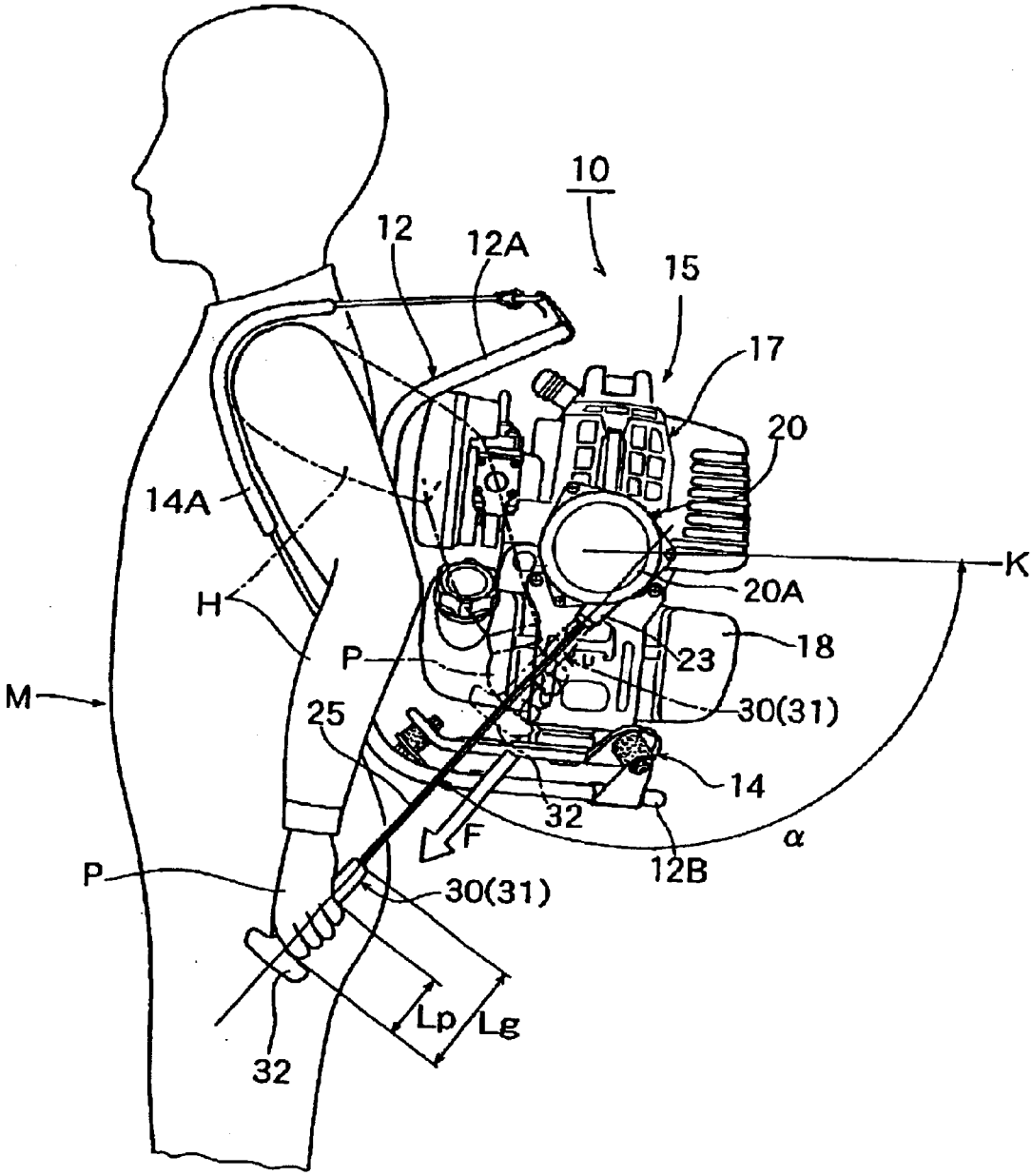
FIG. 3 is a left side view of the power working machine for illustrating the pullout operation of the recoil handle of the starter shown in FIG. 1.

More specifically, as shown in FIG. 3, the recoil handle 30 is formed into a T-shaped configuration in side view, which is constituted by a grip portion 31 which has a length (a length Lg) larger than the width Lp of the palm P of the operator's hand (for example, about twice the width of the palm of the operator's hand) and is linearly extended along the pull-out direction F of the recoil rope 25, and a laterally extended stopper portion (for example, shaped into a circular flange) 32 which is formed on a distal end, in the pull-out direction, F, of the grip portion 31. The recoil rope 25 and the recoil handle 30 are adapted to be pulled down obliquely toward the operator at an angle $\alpha$ (about 120° in this embodiment) to the horizontal plane K.

The grip portion 31 may be of any optional configuration, such as a rod of circular cross-section having a diameter which can be easily grasped with the operator's hand.

In the recoil starter 20 for a backpack type power working machine, which is constructed according to this embodiment, the start-up of the internal combustion engine 17 can be performed as follows. Namely, as shown by an imaginary line in FIG. 3, under the condition where the backpack type power working machine 10 is kept shouldered by an operator M, the grip portion 31 of the recoil handle 30 is grasped with the palm P of the operator's hand by slightly bending his left arm H for example, and then, the grip portion 31 is pulled down obliquely toward the operator (at an angle of about 120° to the horizontal plane K). After the recoil handle 30 has been pulled out in this manner, the grip portion 31 of the recoil handle 30 is permitted to be released from the palm P of the operator's hand. As a result, due to the effect of the recoil-urging means which is built in the main starter body 20A, the recoil handle 30 is automatically brought back to the original position thereof (the state where the recoil handle 30 is impinged against the rope outlet port 23).

Since the recoil handle 30 and the recoil rope 25 are constructed in this manner so as to be pulled down obliquely forward, the starting operation of the recoil starter can be easily performed with the working machine 10 being kept shouldered by the operator's back. Moreover, according to the present invention, since only the mounting posture of the recoil starter 20 and the recoil handle thereof are required to be modified with the main starter body 20A of the recoil starter 20 for a backpack type power working machine being permitted to be the same as the conventional recoil starter, it is possible to make the recoil starter 20 lighter in weight and lower in manufacturing cost as compared with the D.C. motor type recoil starter. Further, since the recoil handle 30 is positioned on the back of the operator, it is possible to prevent the recoil handle from hindering the movement of the operator M during the operation of the power working machine.

Additionally, since the recoil handle 30 is formed into a T-shaped configuration in side view, which is constituted by the linear grip portion 31 having a length larger than the width Lp of the palm P of the operator's hand, and a laterally extended stopper portion 32 which is formed on a distal end, as viewed in the pulling direction, of the grip portion 31, it is possible to entirely grasp the grip portion 31 of the recoil handle 30 and to manipulate the recoil handle 30 without imposing so much load on the grasping fingers as compared with the conventional clutch type recoil handle, thereby making it possible to easily perform the pulling operation of the recoil handle.

Further, since the recoil handle 30 is made longer as compared with the conventional recoil handle so as to dispose it in front of the working machine, it is possible for the operator M to easily reach the position of the recoil handle while shouldering the power working machine on his back. Additionally, since the laterally extended stopper portion 32 is formed on the grip portion 31, it becomes possible to prevent the operator's hand from slipping out of the recoil handle 30, thereby enabling the pullout operation of the recoil handle 30 (starting manipulation of the engine) and making it possible to minimize the failure of the starting manipulation of the engine.

Moreover, the recoil handle 30 can be manipulated in such a manner that the laterally extended stopper portion 32 is grasped with the grip portion 31 being held between the forefinger and middle finger of the operator's hand.

If it is desired that the recoil starter 20 is disposed on the opposite side of the backpack type power working machine 10 by rotating the driving power source portion 15 by an angle of 180°, the fixing means such as screws which anchor the main starter portion 20A of the recoil starter 20 to the internal combustion engine 17 are loosened so to permit the position of the driving power source portion 15 to be moved and adjusted (for example, by rotating the driving power source portion 15). Then, the angle $\alpha$ of the pull-out direction F of the recoil handle 30 is downwardly inclined toward the front side of the working machine 10 by an angle ranging from 100° to 150° to the horizontal plane and fixed at that position, thereby enabling the recoil handle 30 to be suitably manipulated even on the opposite side of the backpack type power working machine 10.

While in the foregoing, one embodiment of the present invention has been explained, it will be understood that the present invention is not limited to the embodiment, but the construction thereof can be varied without departing from the spirit and scope of the invention.

As clearly understood from the above explanation, the starting operation of the recoil starter for a backpack type power working machine according to the present invention can be easily performed with the working machine being kept shouldered by the operator's back. Moreover, since only the mounting posture of the recoil starter and the recoil handle thereof are required to be modified with the other components being permitted to be the same as the conventional recoil starter for a backpack type power working machine, it is possible to make the recoil starter lighter in weight and lower in manufacturing cost as compared with the D.C. motor type recoil starter. Further, since the recoil handle is positioned on the back side of the operator on the occasion of operating the power working machine, it is possible to prevent the recoil handle from hindering the movement of the operator during the operation of the power working machine.

Moreover, since the recoil handle is formed into a T-shaped configuration in side view, which is constituted by the grip portion having a length larger than the width of the palm of the operator's hand and a laterally extended stopper portion which is formed on a distal end, as viewed in the pulling direction, of the grip portion, it is possible to entirely grasp the recoil handle and to manipulate the recoil handle without imposing so much load on the grasping fingers as compared with the conventional clutch type recoil handle, thereby making it possible to easily perform the pulling operation of the recoil handle.

Further, since the recoil handle is made longer as compared with the conventional recoil handle, it is possible for an operator to easily reach the position of the recoil handle while shouldering the power working machine on his back. Additionally, since a laterally extended stopper portion is formed on the grip portion, it becomes possible to prevent the operator's hand from slipping out of the recoil handle, thereby enabling the pullout operation of the recoil handle (starting manipulation of engine) and making it possible to minimize the failure of the starting manipulation of engine.

We claim:

1. A recoil starter for starting an internal combustion engine to be mounted on a backpack type power working machine, comprising a recoil rope;

a recoil handle attached to one end portion of the recoil rope adapted to be pulled downward from a main body of the recoil starter;

a rope outlet port extending obliquely forward from a lower portion of the recoil starter thereby directing the rope outlet port toward an operator's back side;

wherein the recoil handle includes a grip portion;

wherein the recoil rope and the recoil handle are disposed so as to be pulled down obliquely forward at an angle of 100° to 150° to a horizontal plane;

wherein the recoil handle has a T-shaped configuration, comprising the grip portion and a laterally extended stopper portion at a distal end, as viewed in the pull-out direction, of the grip portion;

wherein a driving power source portion including the internal combustion engine of the backpack type power working machine is rotatably supported on a backpack frame so as to enable the driving power source portion to rotate about a vertical line; wherein the main body of the starter is disposed on the right or left side of the driving power source portion; and working means is disposed on the other side of the driving power source portion.

2. The recoil starter according to claim 1, wherein the recoil starter is secured adjustably in position to the driving power source portion.

* * * * *